US011609074B2

(12) United States Patent
Isle et al.

(10) Patent No.: US 11,609,074 B2
(45) Date of Patent: Mar. 21, 2023

(54) MAJOR CALIBER PROJECTILE OBTURATOR

(71) Applicant: BAE Systems Land & Armaments L.P., Arlington, VA (US)

(72) Inventors: Brian J. Isle, Brooklyn Park, MN (US); Charles M. Bies, Andover, MN (US)

(73) Assignee: BAE Systems Land & Armaments L.P., Arlington, VA (US)

( * ) Notice: Subject to any disclaimer, the term of this patent is extended or adjusted under 35 U.S.C. 154(b) by 27 days.

(21) Appl. No.: 17/446,039

(22) Filed: Aug. 26, 2021

(65) Prior Publication Data

US 2022/0065600 A1 Mar. 3, 2022

Related U.S. Application Data

(60) Provisional application No. 62/706,585, filed on Aug. 26, 2020.

(51) Int. Cl.
*F42B 14/02* (2006.01)

(52) U.S. Cl.
CPC ..... *F42B 14/02* (2013.01)

(58) Field of Classification Search
CPC ..... F42B 14/02
USPC ..... 102/527
See application file for complete search history.

(56) References Cited

U.S. PATENT DOCUMENTS

| | | | | | |
|---|---|---|---|---|---|
| 3,744,426 | A * | 7/1973 | Butler | F42B 14/02 | 102/527 |
| 4,366,015 | A * | 12/1982 | Murray | F42B 14/02 | 102/527 |
| 4,552,071 | A * | 11/1985 | Horais | F42B 14/02 | 244/3.28 |
| 4,712,465 | A * | 12/1987 | Macdonald | F42B 14/02 | 102/374 |
| 5,164,538 | A * | 11/1992 | McClain III | F42B 10/24 | 102/501 |
| 9,157,715 | B1 * | 10/2015 | Lafortune | F42B 14/02 | |
| 9,194,675 | B1 * | 11/2015 | Manole | F42B 8/20 | |
| 9,689,649 | B1 * | 6/2017 | Hooke | F42B 14/02 | |
| 11,300,389 | B1 * | 4/2022 | Han | F42B 14/02 | |
| 2017/0276452 | A1 * | 9/2017 | Barnette | F42B 12/56 | |

* cited by examiner

*Primary Examiner* — Samir Abdosh
(74) *Attorney, Agent, or Firm* — Patterson Thuente IP

(57) ABSTRACT

The present invention is an obturator for a guided projectile. The obturator allows for decoupling the projectile from the rotation of the rifled barrel by use of a static band, a front slip band, a rear slip band and a slip disk. The slip disk is disposed between the front and rear slip bands and allows the rear slip band to rotate independently from the front slip band.

10 Claims, 2 Drawing Sheets

MAJOR CALIBER PROJECTILE OBTURATOR

RELATED APPLICATION

The present application claims the benefit of U.S. Provisional Application No. 62/706,585 entitled "MAJOR CALIBER PROJECTILE OBTURATOR", filed Aug. 26, 2020, which is incorporated herein by reference in its entirety.

TECHNICAL FIELD

The present disclosure relates generally to major caliber projectiles. More particularly, the present disclosure relates to a spin decoupling projectile obturator.

BACKGROUND OF THE INVENTION

Conventional gun barrels in major caliber gun systems often incorporate rifling profiles that induce gyroscopic stability into ballistic projectiles. Inducing gyroscopic stability can be problematic for guided projectiles because control surfaces must be sized in order to counter launch induced spin.

Traditionally, obturators, both in-service and in development, have utilized a two-piece system. Two-piece systems typically comprise of an underlying "static" band that interfaces with the projectile body, and a "seal" band that interfaces with the gun barrel. Analogous to slip obturation rings used in sabots, two-piece obturator designs aim to seal the obturator in the gun's barrel and allow high pressure gases to propel the projectile, while avoiding transferring the total spin rate of the rifling into the projectile.

One approach to countering launch spin is through the use of "slipping" obturators, which reduce spin by de-coupling the projectile from the gun's rifling while in the gun's bore or barrel. Obturators of smart projectiles typically attempt to reduce the rotational velocity imposed by the rifling of the barrel by "slipping." The obturator band thus causes the projectile to spin at a velocity less than that achieved through a direct coupled obturator.

Typically, obturators are made from thermal plastic materials with relatively low melting temperatures; thus, modern obturators are not suitable for barrel temperatures generated by gun systems with high firing rates and automated rammers. Further, the innate complexities of de-coupling techniques are compounded by the necessity to maintain a gas-tight seal, against very high pressure, while the projectile travels down the gun's bore.

Thus there is a need for an obturator that allows for more efficient firing of guided projectiles.

SUMMARY OF INVENTION

Embodiments described or otherwise contemplated herein describe a hot-gun, spin de-coupling obturator for use with major caliber projectiles.

The present disclosure describes an obturator that stops projectiles in the same position when power rammed, and prevents projectile fallback from the seated position within a gun barrel with a surface temperature exceeding 450 degrees Fahrenheit. Furthermore, the hot-gun, spin de-coupling obturator seals against gun pressures in excess of 70,000 pounds per square inch ("psi"), and limits the launch induced spin rate.

In embodiments, the spin de-coupling obturator includes a stationary band, a forward obturator band, a rear obturator band, and a slip disk.

In embodiments, the forward edge of the stationary band comprises a slight ramp to force the forward obturator band toward the gun bore. The stationary band can be thicker than legacy components.

In embodiments, the forward obturator band has a ramp matching the stationary band on the leading edge, a tapered outer diameter, and a small cannelure on the inner diameter. The forward obturator band can be fabricated from material that is compatible with ramming, seating, and thermal environments.

In one embodiment, the rear obturator band has a ramp matching the forward obturator band on the leading edge, a tapered outer diameter, and a small cannelure on the inner diameter. The rear obturator band can be fabricated from different material than the forward obturator band, and is optimized for sealing robustness.

In one embodiment, a slip disk is positioned between the forward obturator band and the rear obturator band. The slip disk can be fabricated from material that provides low friction at high velocities and loading.

The term "forward obturator band" is interchangeable with "front slip band", and "rear obturator band" is interchangeable with "rear slip band".

The present invention is a spin decoupling obturator for a projectile comprising; a stationary band, said stationary band disposed about the projectile, a front slip band, a rear slip band, and a slip disk, said slip disk positioned between the front slip band and the rear slip band, wherein the front slip band, the rear slip band and the slip disk are disposed about the stationary band. The slip disk allows differential spinning rates between the front slip band and the rear slip band. The stationary static band is configured as the load bearing surface when pressurized.

The front slip band is annular in shape and includes a forward ramp surface, a rear ramp surface, said forward ramp surface forces the band axially outward toward a gun bore. The front slip band further includes an inner cannelure for expansion of the front slip band. The rear slip band includes a rear inner cannelure for expansion of the rear slip band. The rear slip band includes a matching ramp on a leading edge to mate with the front slip band. A ring retainer optionally may be used to maintain the position of the front slip band, the rear slip band and the slip disc relative to the projectile.

The above summary is not intended to describe each illustrated embodiment or every implementation of the subject matter hereof. The figures and the detailed description that follow more particularly exemplify various embodiments.

BRIEF DESCRIPTION OF THE DRAWINGS

Subject matter hereof may be more completely understood in consideration of the following detailed description of various embodiments in connection with the accompanying figures, in which.

Figure 1:
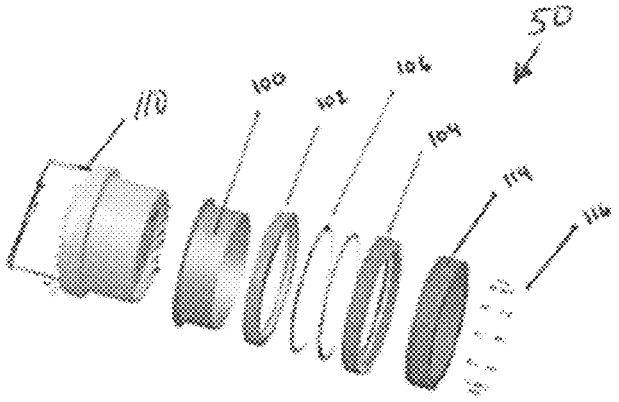
FIG. 1 is an exploded, isometric side view of a spin de-coupling projectile obturator connected to a projectile.

While various embodiments are amenable to various modifications and alternative forms, specifics thereof have been shown by way of example in the drawings and will be described in detail. It should be understood, however, that the intention is not to limit the claimed inventions to the particular embodiments described. On the contrary, the intention is to cover all modifications, equivalents, and alternatives falling within the spirit and scope of the subject matter as defined by the claims.

DETAILED DESCRIPTION OF THE DRAWINGS

The following detailed description should be read with reference to the drawings in which similar elements in different drawings are numbered the same. The drawings, which are not necessarily to scale, depict illustrative embodiments and are not intended to limit the scope of the invention.

Figure 2:
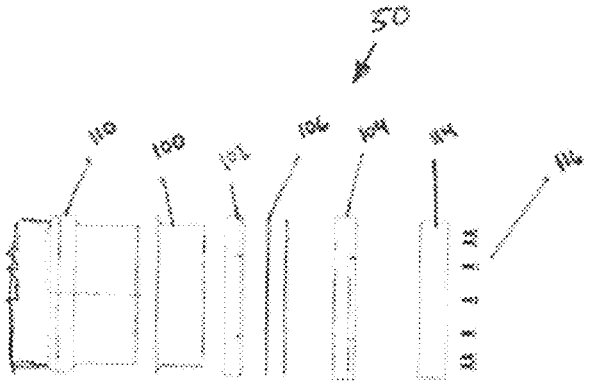
FIG. 2 is an exploded, side view of the spin de-coupling projectile obturator of FIG. 1.
Figure 3:
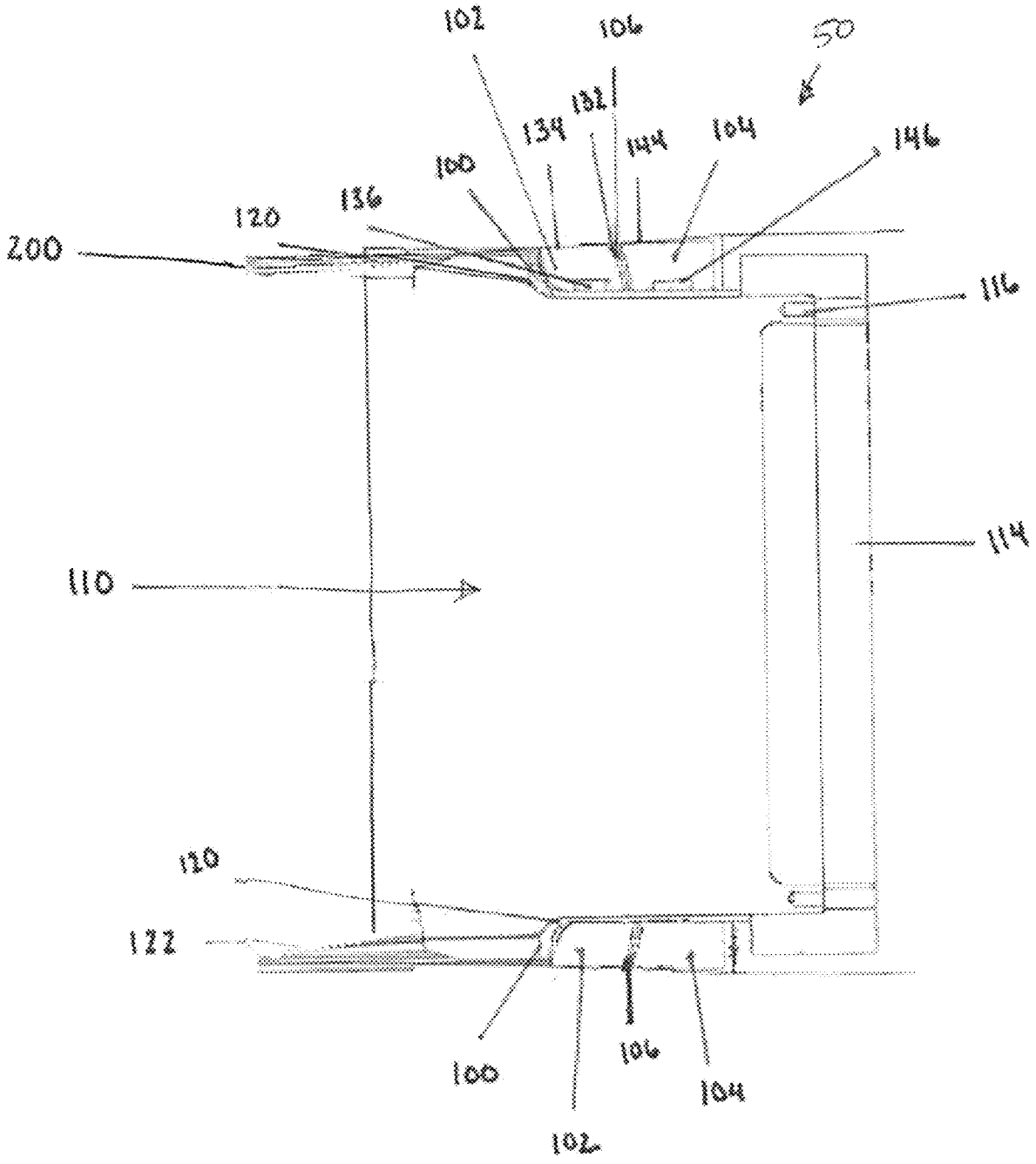
FIG. 3 is a cross-sectional, side view of the spin de-coupling projectile obturator positioned in a gun barrel.

As depicted in FIGS. 1, 2 and 3, obturator 50 generally includes stationary band 100, forward obturator band 102, rear obturator band 104, and slip disk 106. Stationary band 100 holds forward obturator band 102, slip disk 106, and rear obturator band 104. Stationary band 100 can couple with a projectile 110 and can be housed by ring retainer 114. The assembly can be fastened with plurality of socket head cap screws 116.

In an alternative embodiment, a plurality of slip disks 106 can be used.

The stationary band 100 is generally annular in shape and includes a ramp and ramp base. The ramp is coupled to the forward portion of the stationary band. The ramp base is coupled to a forward portion of the base of ramp and is thicker than traditional obturator static band bases. Stationary band can be fabricated of materials suited to withstand high pressures and temperatures, such as polypropylene.

The forward obturator band is generally annular in shape, and includes a forward ramp, a rear ramp, a tapered outer diameter, and an inner cannelure. The forward ramp is coupled to the forward portion of the forward obturator band and is configured to comport with the ramp of the stationary band. The rear ramp is coupled to the rear portion of the forward obturator band. The tapered outer diameter is positioned at the exterior of the forward obturator band and is configured to be suitable with critical barrel features. The inner cannelure is positioned at the interior of the forward obturator band and is configured to permit expansion of the forward obturator band. Forward obturator band can be fabricated of materials compatible with seating, ramming, and extreme thermal environments, such as polyetherimides.

The rear obturator band is generally annular in shape, and includes a forward ramp, a rear end, a tapered outer diameter, and an inner cannelure. The forward ramp is coupled to the forward portion of the rear obturator band and is configured to comport with the rear ramp of the forward obturator band. The rear end is coupled to the rear portion of the rear obturator band and is configured to abut the ring retainer. The tapered outside diameter is positioned at the exterior of the rear obturator band and is configured to be suitable with critical barrel features. The inner cannelure is positioned at the interior of the rear obturator band and is configured to permit expansion. The rear obturator band can be fabricated of materials suited for robust sealing, such as acetal homopolymers.

The slip disk is generally annular in shape. The slip disk can be fabricated of materials that permit low friction at high loading velocities, such as liquid photopolymers.

In assembly, as depicted in FIGS. 1-3, static or stationary band 100 holds forward obturator slip band 102, rear obturator slip band 104, and slip disk 106. Slip disk 106 is positioned between forward obturator band 102 and rear obturator band 104. The bottom of stationary band 100 couples the forward portion of projectile 110. The stationary static band 100, forward slip band 102, rear slip band 104, and slip disk 106 are housed by ring retainer 114. Ring retainer 114 is fastened to projectile 110 by a plurality of socket head cap screws 116 or other fasteners.

In operation, the thickened base of stationary band 100 is configured as the load bearing feature when spin de-coupling obturator 50 is pressurized in the gun barrel. When pressurized, the ramp 120 of the stationary band 100 is configured to force forward the obturator band toward the exterior gun bore or barrel rifling. The tapered outer diameter, and use of tailored materials compatible with ramming, seating, and thermal environments, allows the forward obturator band to hold securely in the exterior gun bore or barrel rifling. Furthermore, when pressurized rear ramp of the forward obturator band is configured to force rear obturator band toward the exterior gun bore or barrel rifling. The tapered outer diameter, and use of tailored materials optimized for sealing robustness, allows rear obturator band 104 to seal the gun bore or barrel rifling, and permits differential spinning rates. In addition, when pressurized, the slip disk allows load transfer between the forward obturator band and the rear obturator band, and reduces frictional forces at a high velocity and during loading. Similarly, the forward obturator band inner cannelure and rear obturator band inner cannelure allow for the forward obturator band and the rear obturator band expansion during ramming, seating, and in extreme thermal environments.

In operation, as depicted in FIG. 3, thickened base 122 of stationary band 100 is configured as the load bearing feature when spin de-coupling obturator 50 is pressurized in the gun barrel. When pressurized, ramp 120 of stationary band 100 is configured to force forward obturator band 102 toward the exterior gun bore or barrel rifling 200. The tapered outer diameter 134, and use of tailored materials compatible with ramming, seating, and thermal environments, allows forward obturator band 102 to hold securely in the exterior gun bore or barrel rifling 120. Furthermore, when pressurized, rear ramp 132 of forward obturator band 102 is configured to force rear obturator band 104 toward the exterior gun bore or barrel rifling 200. The tapered outer diameter 144, and use of tailored materials optimized for sealing robustness, allows rear obturator band 104 to seal the gun bore or barrel rifling 200, and permits differential spinning rates.

In addition, when pressurized slip disk 106 allows load transfer between forward obturator band 102 and rear obturator band 104 and reduces frictional forces at a high velocity and during loading. Similarly, forward obturator band inner cannelure 136 and rear obturator band inner cannelure 146 allow for forward obturator band 102 and rear obturator band 104 expansion during ramming, seating, and in extreme thermal environments.

Various embodiments of systems, devices, and methods have been described herein. These embodiments are given only by way of example and are not intended to limit the scope of the claimed inventions. It should be appreciated, moreover, that the various features of the embodiments that have been described may be combined in various ways to produce numerous additional embodiments. Moreover, while various materials, dimensions, shapes, configurations and locations, etc. have been described for use with disclosed embodiments, others besides those disclosed may be utilized without exceeding the scope of the claimed inventions.

Persons of ordinary skill in the relevant arts will recognize that the subject matter hereof may comprise fewer features than illustrated in any individual embodiment described above. The embodiments described herein are not meant to be an exhaustive presentation of the ways in which the various features of the subject matter hereof may be combined. Accordingly, the embodiments are not mutually exclusive combinations of features; rather, the various embodiments can comprise a combination of different individual features selected from different individual embodiments, as understood by persons of ordinary skill in the art. Moreover, elements described with respect to one embodiment can be implemented in other embodiments even when not described in such embodiments unless otherwise noted.

The invention claimed is:

1. A spin decoupling obturator for a projectile comprising;

a stationary band, said stationary band disposed about the projectile, a front slip band, a rear slip band, and a slip disk, said slip disk positioned between the front slip band and the rear slip band, wherein the front slip band, the rear slip band and the slip disk are disposed about the stationary band.

2. The spin decoupling obturator of claim 1 wherein the slip disk allows differential spinning rates between the front slip band and the rear slip band.

3. The spin decoupling obturator of claim 1 wherein the stationary band is configured as the load bearing surface when pressurized.

4. The spin decoupling obturator of claim 1 wherein the front slip band is annular in shape and includes a forward ramp surface, a rear ramp surface, said forward ramp surface forces the band axially outward toward a gun bore.

5. The spin decoupling obturator of claim 4 wherein the front slip band further includes an inner cannelure for expansion of the front slip band.

6. The spin decoupling obturator of claim 1 wherein the rear slip band includes a rear inner cannelure for expansion of the rear slip band.

7. The spin decoupling obturator of claim 1 wherein the rear slip band includes a matching ramp on a leading edge to mate with the front slip band.

8. The spin decoupling obturator of claim 1 further including a ring retainer to maintain the position of the front slip band, the rear slip band and the slip disc relative to the projectile.

9. The spin decoupling obturator of claim 1 wherein the front slip band and the rear slip band are constructed of different materials.

10. A method for decoupling a guided projectile from the rifling of a hot gun during firing, the method comprising;

providing a spin decoupling obturator about the guided projectile, said spin decoupling obturator including a stationary band, said stationary band disposed about the projectile, a front slip band, a rear slip band, and a slip disk, said slip disk positioned between the front slip band and the rear slip band, pressurizing the guided projectile by firing to force the front slip band radially outward to engage a gun barrel;

forcing the rear ramp of the front slip band to force the rear slip band radially outward to engage the gun barrel; and positioning the slip disk between the front slip band and the rear slip band so that rear slip band can rotate independently of the front slip band.

* * * * *